US006193488B1

(12) United States Patent
Kamiya et al.

(10) Patent No.: US 6,193,488 B1
(45) Date of Patent: Feb. 27, 2001

(54) SCROLL TYPE COMPRESSOR

(75) Inventors: Haruo Kamiya, Chiryu; Yusuke Sakurai, Nagoya; Tsuyoshi Takemoto, Nukata-gun; Kimihiko Sato, Chiryu, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/328,292

(22) Filed: Jun. 9, 1999

(30) Foreign Application Priority Data

Jun. 12, 1998 (JP) ..... 10-165342

(51) Int. Cl.[7] ..... F01K 1/02
(52) U.S. Cl. ..... 418/55.2
(58) Field of Search ..... 418/55.2

(56) References Cited

U.S. PATENT DOCUMENTS 4,579,512 * 4/1986 Shiibayashi et al. ..... 418/55.2

FOREIGN PATENT DOCUMENTS 57-62988 4/1982 (JP) .
0013184 * 1/1983 (JP) ..... 418/55.2
0012187 * 1/1984 (JP) ..... 418/55.2
0164589 * 7/1991 (JP) ..... 418/55.2
58-13184 1/1993 (JP) .

* cited by examiner

*Primary Examiner*—Thomas Denion
*Assistant Examiner*—Theresa Trieu
(74) *Attorney, Agent, or Firm*—Pillsbury Winthrop LLP

(57) ABSTRACT

In a scroll type compressor, the center and outer periphery portions of the spiral elements are provided with relief for preventing the mutual contact of the spiral elements. Both of the spiral elements come to contact with each other at the intermediate portion thereof. The relief at the center portion is formed within the range defined by the winding angle Y=32(X−1) where X is the winding turn of each of the spiral elements. The range of the intermediate portion is 380°. This construction serves to prevent the excessive pressure increase of the operation chamber at the center portion so that the brake down of the spiral elements may be prevented without lowering the efficiency of the compressor.

2 Claims, 5 Drawing Sheets

$\theta = 0°, 360°, 720°$ $\theta = 90°, 450°, 810°$ $\theta = 180°, 540°, 900°$ $\theta = 270°, 630°$

SCROLL TYPE COMPRESSOR

CROSS REFERENCE TO RELATED APPLICATION

This application is based upon and claims the benefit of priority of Japanese Patent Applications No. H.10-165342 filed on Jun. 12, 1998, the contents of which are incorporated herein by reference.

BACKGROUND OF THE INVENTION

1. Field of the Invention

The present invention relates to a scroll type compressor for sucking, compressing and discharging fluid, more particularly, the construction of the spiral elements thereof.

2. Description of Related Art

A scroll type compressor, as known well, compresses fluid in a manner that the volume of the operation chamber, which is constituted by bringing a movable scroll spiral element into contact with a fixed scroll spiral element, is reduced according to the rotation of the movable scroll spiral element. However, due to a fabrication error on manufacturing the respective spiral elements or a deformation of the spiral elements by compression reaction and thermal expansion, there may cause a problem that both spiral elements come to an insufficient contact with each other and fluid leaks to a lower pressure side between the adjacent operation chambers.

To cope with this problem, it has been proposed, as described in JP-A-57-62988 and Jp-A-58-13184, that the dimensions of the respective spiral elements are designed to ensure the accurate contact of both the spiral elements within an angle of 360 degrees from the spiral starting point and the spiral elements are provided with relief after the angle of 360 degrees to prevent the possible contact of the spiral elements.

However, when both the spiral elements come to the positive contact within the range of the center portions of the spiral elements, lubricant oil tends to be compressed at the operation chamber at the center portions where the volume is reduced and so called "liquid compression" may occur. Further, there is a fear that the spiral elements may be broken down by an excessive pressure increase of the operation chamber, because the compression reaction becomes larger as the operation chamber is located more nearly to the center portion.

SUMMARY OF THE INVENTION

The present invention has been made in view of the above mentioned problem, and an object of the present invention is to provide a scroll type compressor in which the spiral elements are constructed not to be easily broken down without affecting the compression efficiency (capacity). To achieve the object, at least one of the spiral elements is provided with relief at the center and outer periphery portions to prevent the mutual contact of the spiral elements during the ranges thereof and the spiral elements come to contact with each other only at the intermediate portion of the spiral elements. Even if the relief is formed at the center and outer periphery portions of the spiral elements, the compression efficiency can not be largely lowered, but, if anything, the efficiency may be slightly increased. On the other hand, the possible brake down of the spiral elements can be effectively prevented, as the center portion of the spiral elements is provided with the relief and the pressure at the center portion of the operation chamber can not be excessively compressed. It is preferable that the range of the intermediate portion where the spiral elements come to contact with each other is 380°±20°. Further, the center portion covering the range defined by a winding angle (Y) according to the below equation is provided with the relief;

$$Y=a(X-1)$$

Where Y is a spiral winding angle, X is a winding turn of the spiral elements, and a constant a is a given number of more than 0 (including 0), but not more than 64, more preferably a number of not less than 6, but not more than 48. Even if a=0 and, therefor, Y=0, the relief is provided within a certain amount of the range of 0 degree where both of the spiral elements come to contact with each other in case that the relief is not provided.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
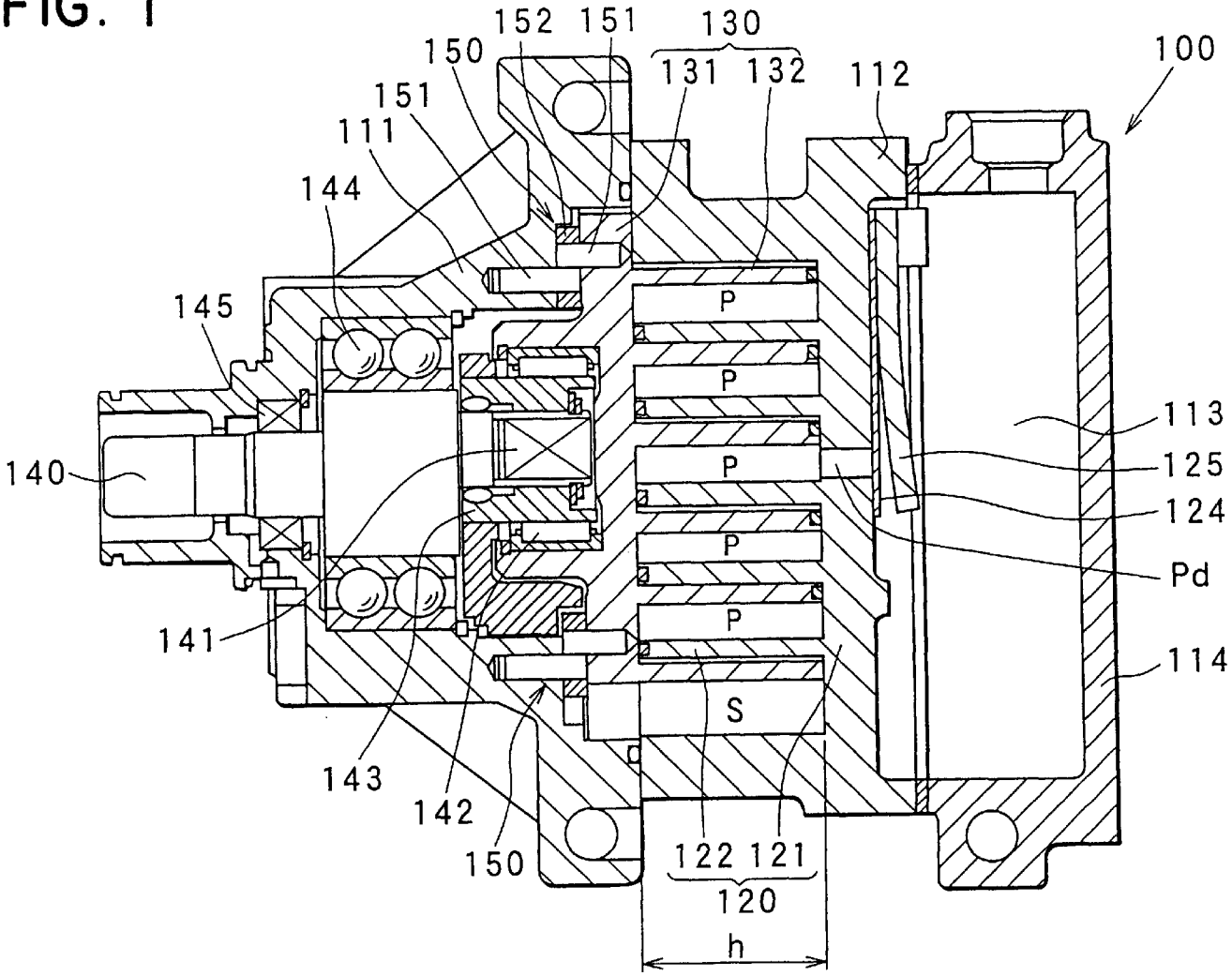
FIG. 1 is a cross sectional view of the scroll type compressor according to the embodiment of the present invention.

The present invention is applicable to a scroll type compressor (hereinafter called compressor) to be used in a refrigeration cycle for vehicles. FIG. 1 shows an axial cross sectional view of the compressor 100 according to an embodiment of the present invention. A shell (intermediate housing) 112 is fixed with a front housing 111 and constitutes a space where a movable scroll member 130 makes a rotating movement. The shell 112 has a fixed side end plate 121 and a spiral shaped fixed spiral element 122 integrated with the end plate 121. A fixed scroll member 120 is comprised of the fixed spiral element 122 and the fixed side end plate 121.

The movable scroll member 130 is comprised of a movable side end plate 131 and a spiral shaped movable spiral element 132 which are integrated with the end plate 131 and meshed with the spiral element 122 of the fixed scroll member 120. The movable scroll member 130 can make a rotating movement in the front housing 111 (along the fixed scroll member 120).

A shaft 140 to be rotated by an outside driving force (not shown) such as an engine for vehicles rotatably drives the movable scroll member 130. The shaft 140 is provided with an eccentric portion 141 (crank portion) at the periphery that is positioned on the side of the movable scroll member 130, being off set from the rotating axis thereof. The movable scroll member 130 is connected via a bearing 142 with the eccentric portion 141. According to the present embodiment, a bushing 143 is arranged between the eccentric portion 141 and the bearing 142 in order for the movable scroll member 130 to be able to shift slightly from the eccentric portion 141. These constitute so-called a slave crank mechanism that the contact surface pressure of the spiral elements 122 and 132 may be increased according to the slight movement of the movable scroll member 130 via the bushing 143 due to the compression reaction force.

There is provided with a spin prevention mechanism 150 that the movable scroll member 130 may be prevented from turning around the eccentric portion 141, when the shaft 140 rotates and the rotating movement of the movable scroll member 130 is made along the fixed scroll member 120. The spin prevention mechanism 150 is comprised of the end plate 131, pins 151 press fitted into the front housing 111 and a ring 152 into which the pins 151 are inserted from both sides. Therefor, when the shaft 140 rotates, the movable scroll member 130 does not spin with the rotation of the shaft 140, but revolves around the shaft 140.

Figure 2:
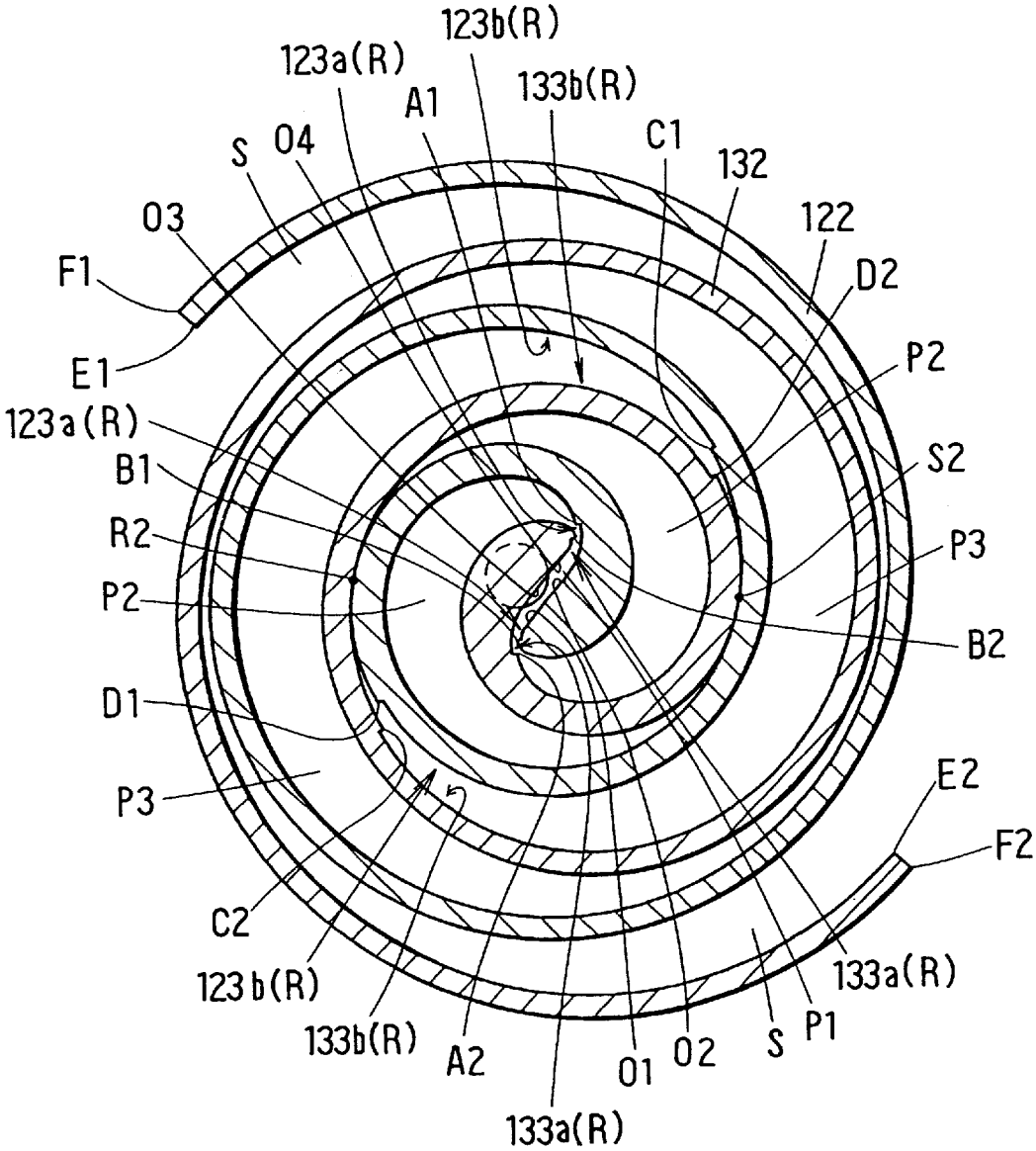
FIG. 2 is a cross sectional view of the spiral elements of the scroll type compressor according to the present invention.

Both of the spiral elements 122 and 132 come to contact with each other at a plurality of points and constitute operation chambers P (compression chamber) where fluid (refrigerant in the present embodiment) is shut in, as shown in FIG. 2. The fluid is compressed by reducing the volume of the operation chamber P according to the rotating movement of the movable scroll member 130.

The contact points of both the spiral elements 122 and 132 are hereinafter called $S_n$ and $R_n$ (n=1, 2 and so on from the center). Further, a space formed by the shell 112 and the most outer peripheries of the spiral elements 122 and 132 constitutes an intake chamber S (refer to FIG. 1) communicating to an intake port (not shown) of the compressor 100. Both the spiral elements 122 and 132 are provided, at the center and the outer periphery portions thereof, with relief 123*a*, 123*b*, 133*a* and 133*b* for preventing the mutual contact of the spiral elements 122 and 132 during the ranges thereof. On the other hand, during the range intermediate between the center and the outer periphery portions of the spiral elements 122 and 132, the dimensions of the respective spiral elements 122 and 132 are defined so as to secure the accurate contact of the spiral elements 122 and 132 which constitutes the contact points $S_n$ and $R_n$. More detail definition of the center, intermediate and outer periphery portions will be explained later.

The relief 123*a* is constituted by making the thickness of the spiral element 122 thin during the ranges from O1 to A1 and from O2 to B1. Similarly, the relief 123*b* is constituted by making the thickness of the spiral element 122 thin during the ranges from C1 to E1 and from D1 to F1. On the other hand, the relief 132*a* is constituted by making the thickness of the spiral element 132 thin during the ranges from O3 to A2 and from O4 to B2. Similarly, the relief 132*b* is constituted by making the thickness of the spiral element 132 thin during the ranges from C2 to E2 and from D2 to F2. The relief 123*a*, 123*b*, 132*a* and 132*b* will be severally or collectively described as the relief R, case by case.

As shown in FIG. 1, a discharge port Pd provided for discharging fluid compressed in the operation chamber P communicates to a discharge room 113 where the pulsation of fluid discharged from the discharge port is smoothed. The discharge room 113 is constituted by the end plate 121 (the shell 112) and a rear housing 114. There are provided with a reed shaped discharge valve 124 for preventing the reverse flow of fluid from the discharge room 113 to the operation chamber P, a stopper 125 (valve stopper) for restricting the maximum opening of the discharge valve 124, a bearing 144 for rotatably holding the shaft 140 and a lip seal 145 for preventing the fluid leakage to outside of the compressor 100, respectively.

The center portion of the spiral element 122 or 132 means the range within the winding angle of the spiral element Y (refer to FIG. 3) defined in a below equation;

$$Y=a(X-1)$$

Where

Y: winding angle

X: winding turn of the spiral element a: 32

Figure 4A:
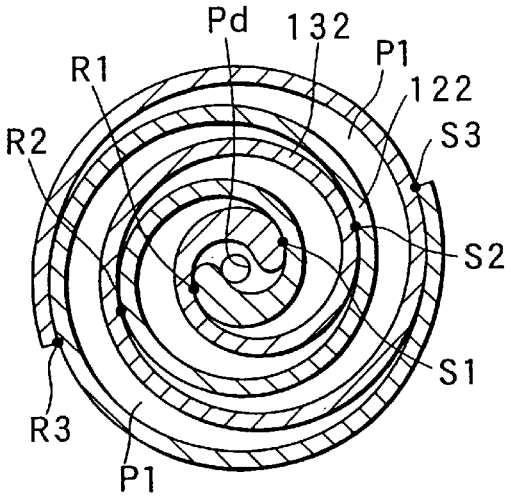
FIG. 4A is a first cross sectional view of the spiral elements for explaining the winding turn of the spiral elements.
Figure 4B:
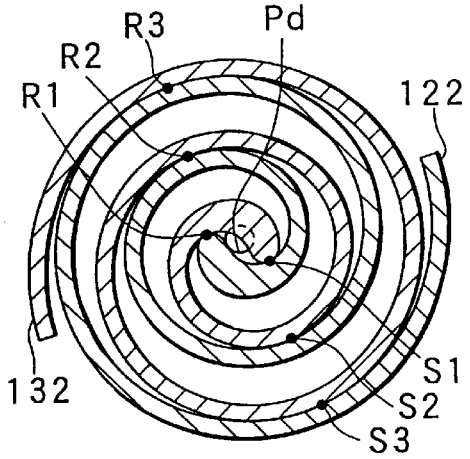
FIG. 4B is a second cross sectional view of the spiral elements for explaining the winding turn of the spiral elements.
Figure 4C:
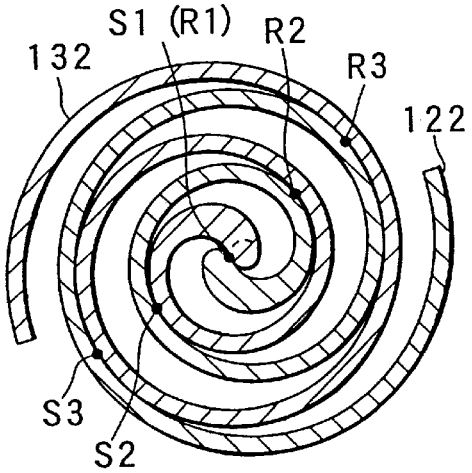
FIG. 4C is a third cross sectional view of the spiral elements for explaining the winding turn of the spiral elements.
Figure 4D:
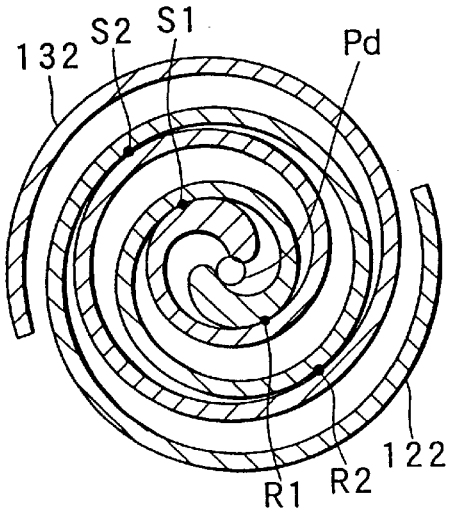
FIG. 4D is a forth cross sectional view of the spiral elements for explaining the winding turn of the spiral elements.
Figure 5A:
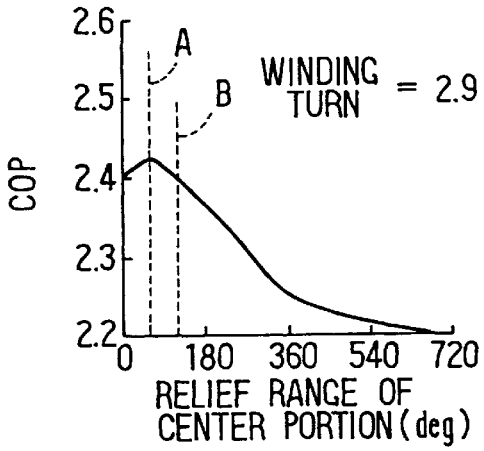
FIG. 5A is a graph showing the relationship between the relief range of the center portion and the coefficient of performance of refrigeration cycle at 2.9 winding turn.
Figure 5B:
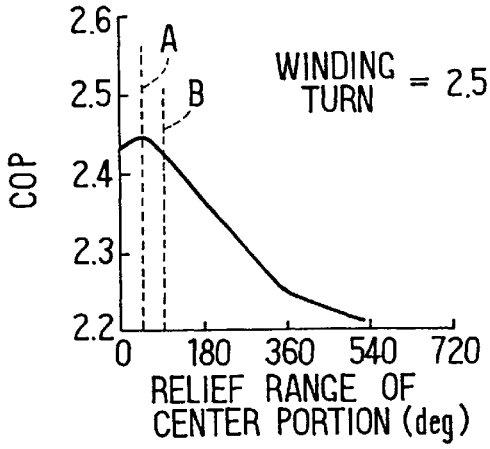
FIG. 5B is a graph showing the relationship between the relief range of the center portion and the coefficient of performance of refrigeration cycle at 2.5 winding turn.
Figure 5C:
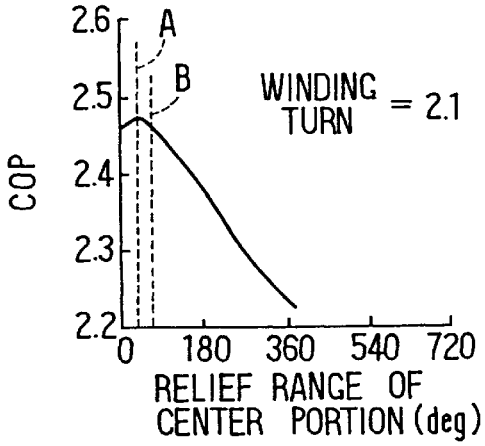
FIG. 5C is a graph showing the relationship between the relief range of the center portion and the coefficient of performance of refrigeration cycle at 2.1 winding turn.
Figure 5D:
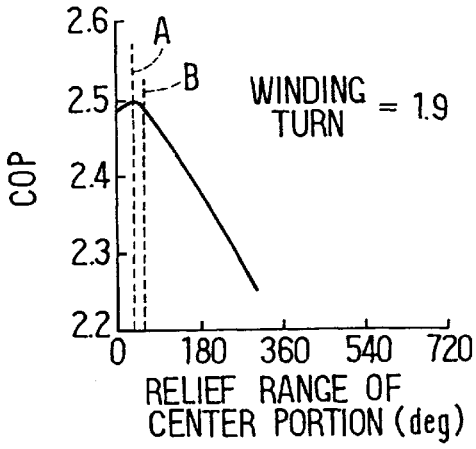
FIG. 5D is a graph showing the relationship between the relief range of the center portion and the coefficient of performance of refrigeration cycle at 1.9 winding turn.
Figure 5E:
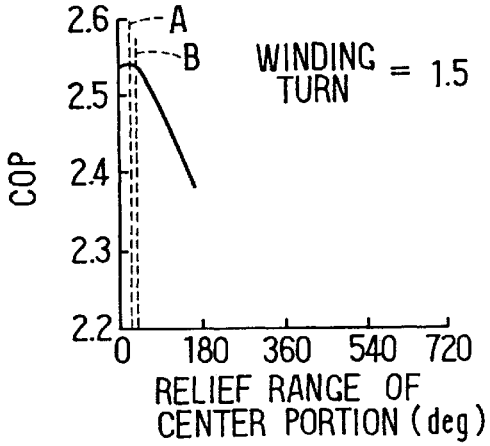
FIG. 5E is a graph showing the relationship between the relief range of the center portion and the coefficient of performance of refrigeration cycle at 1.5 winding turn.

The winding turn of the spiral element is a figure that the rotating angle θ of the shaft 140 (the rotating movement angle of the movable scroll member 130) is divided by 360° in which θ is the angle from the first point where, in case that the relief R are not provided, the contact points S3 and R3 are formed at the most outer periphery portions of the spiral elements 122 and 132, as shown in FIG. 4A (when fluid is sucked into the operation chamber P and the chamber is shut in), via the intermediate points where the volume of the operation chamber P formed by the contact points S3 and R3(hereinafter called operation chamber P1) is reduced gradually as shown in (FIG. 4A)→(FIG. 4B)→(FIG. 4C)→(FIG. 4D)→(FIG. 4A)→(FIG. 4B)→(FIG. 4C)→(FIG. 4D)→(FIG. 4A)→(FIG. 4B)→(FIG. 4C) according to the rotation of the shaft 140, to the last point where fluid in the operation chamber P1 is discharged and the most inner periphery portions of the spiral elements 122 and 132 come to contact with each other. According to the embodiment shown in FIGS. 4A to 4D, the winding turn of the respective spiral elements 122 and 132 is 2.50, as the rotating angle of the shaft 140 is 900°.

The winding angle Y is the rotating angle of the shaft 140 (rotating movement angle of the movable scroll member 130), where, in case that the relief Rare not provided, the rotating angle θ of the shaft 140 is 0° as a starting point, when the most inner periphery portions of the spiral elements come to contact with each other to constitute the contact points S1 and R1, and the rotating angle θ of the shaft 140 is shown as an angle representing the movement amount of the contact points S1 and R1, when the contact points S1 and R1 move from the most inner periphery portions toward the outer periphery portions along the spiral elements according to the reverse rotation of the shaft 140 (the movable scroll 130). For example, the range within 50° of the winding angle Y means the range during which the contact points S1 and R1 move along the spiral elements when the shaft 140 rotates reversibly by 50°, in case that the relief R are not provided, from the starting point where the most inner periphery portions of the spiral elements 122 and 132 come to contact with each other.

The intermediate portion of the spiral element 122 or 132 means the range covering the winding angle (this winding angle is called a second winding angle Y2) that is advanced by 380°±20° from the upper end winding angle of the center portion(this winding angle is called a first winding angle Y1). According to the present embodiment, the range of the intermediate portion is 360°.

The outer periphery portion of the spiral element 122 or 132 means the range covering the winding angle from the upper end of the second winding angle Y2 to the leading end of the outer periphery of the spiral element 122 or 132. The leading end of the outer periphery is defined within the scope that the movable and fixed spiral elements 122 and 132 come to contact with each other in case that the relief R are not provided. According to the present embodiment, as each of the winding turns of both the scroll members 120 and 130 is 2.5 and a=32, the first winding angle is 48° and the second winding angle is 428°. Therefor, the range of the center portion is from the starting point to 48°, the range of the intermediate portion is from 48° to 428° and the range of the outer periphery portion is from 428° to 900°.

According to the above mentioned embodiment, the refrigerant (fluid) leaked from the operation chamber of the center portion (hereinafter called operation chamber P1) will never leak to the operation chamber of the outer periphery chamber (hereinafter called operation chamber P3) via the operation chamber of the intermediate portion (hereinafter called operation chamber P2), as both of the spiral elements 122 and 132 come certainly to contact with each other, even if the relief 123*a* and 133*a* are provided at the center portion.

Therefor, with respect to the mass volume of refrigerant to be discharged from the compressor 100, there is not much difference whether or not the relief 123*a* and 133*a* are provided at the center portion. Further, though the refrigerant leaked from the operation chamber P1 brings the pressure increase of the operation chamber P2 so that the amount of mechanical work (compression work) of the compressor 100 may increase in general, there is not so much difference of the amount of the work of the compressor 100 whether or not the relief 123*a* and 133*a* are provided at the center portion, because the pressure increase of the operation chamber P2 is limited as the volume of the operation chamber P1 is relatively small.

Therefor, in case that the relief are provided at the center portion, the efficiency of the compressor 100 may be not largely lowered, on the contrary, may be slightly increased as described later in detail. The efficiency of the compressor 100 is a ratio (Q/W) of the mass volume Q to be discharged from the compressor 100 to the amount of mechanical work W (compression work) of the compressor to be required for obtaining the mass volume, which is a value nearly proportional to the coefficient of performance (COP) for refrigeration cycle.

It may be prevented that the spiral elements 122 and 132 are broken down by the excessive pressure increase of the operation chamber P1, as the relief 123*a* and 133*a* are provided at the center portion. Further, as the relief 123*b* and 133*b* are also provided at the outer periphery portion, the refrigerant leaked from the operation chamber P3 flows back to the intake chamber S and is not discharged. However, the amount of the leaked refrigerant is small because the pressure difference between the operation chamber P3 and the intake chamber S and, with respect to the mass volume to be discharged from the compressor 100, there is not much difference whether or not the relief 123*b* and 133*b* are provided at the outer periphery portion. As mentioned above, the coefficient of performance of the compressor 100 may not be largely lowered, even if the relief 123*b* and 133*b* are provided at the outer periphery portion.

Furthermore, as the mutual contact of the spiral elements 122 and 132 are secured at the intermediate portion, the fluid leakage between the operation chambers P2 and P3 where the pressure difference is large can be certainly prevented. Therefor, the efficiency (capacity) of the compressor 100 will not be lowered, as the pressure increase of the operation chamber P3 due to the fluid leakage, that is, the increase of the compression work of the compressor 100 may be prevented.

Figure 3:
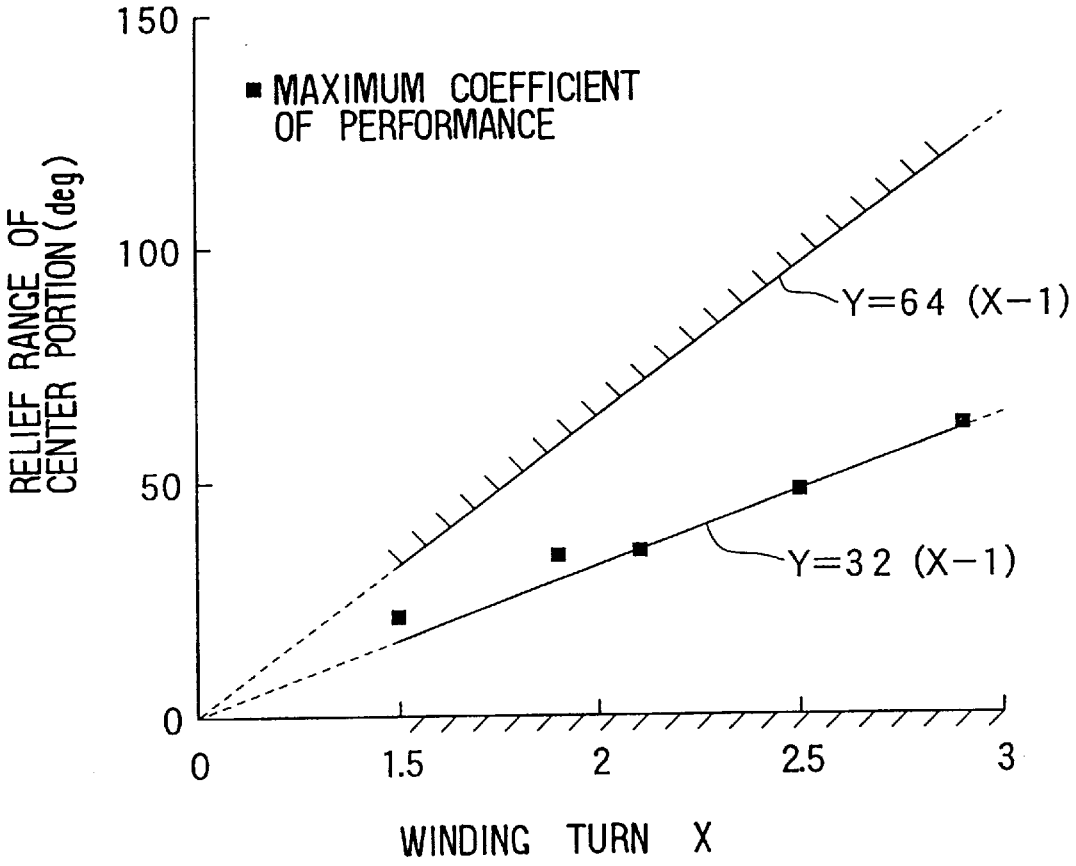
FIG. 3 is a graph showing the relationship between the winding turn X and the relief range of the center portion.

FIGS. 5A to 5E are graphs showing the relationship between the range of the center portion where the relief 123*a* and 133*a* are provided (the range from the starting point to the first winding angle Y1) and the coefficient of performance of the refrigerant cycle (COP) which is obtained by a numerical simulation analysis, separately in each winding turn X as a parameter. In FIGS. 5A to 5E, A shows the range of the center portion (the first winding angle Y1) corresponding to the maximum COP in respective winding turns X. B shows the relief range of the center portion (the first winding angle Y1) corresponding to the COP value that is less by 1% than the maximum COP in respective winding turns X. Each of the relief range of the center portion corresponding to the maximum COP in each winding angle is plotted as a black square mark in FIG. 3 and the equation, Y=32 (X−1), is obtained by presuming the respective values of the plotted black square marks approximately as linear function. With respect to the values less by 1% than the maximum COP, the equation, Y=64 (X−1), as also shown in FIG. 3, is obtained in the similar way mentioned above.

On caring out the numerical simulation analysis, the respective winding turns X of the winding members 122 and 132 are kept same and the dimensions of the winding members 122 and 132 are so defined by analogous design that the height h (refer to FIG. 1) of the respective winding members 122 and 132, the intake volume of the compressor and the relief amount at the portion of the relief R (minimum clearance between the spiral elements 122 and 132 at the portion of the relief R) are kept constant. The intake volume of the compressor is the maximum volume of the operation chamber P.

As clearly understood from FIGS. 3 and 5A to 5E, the compressor 100 according to the embodiment mentioned above has a construction that the brake down of the spiral elements 122 and 132 may be prevented, while the coefficient of performance of refrigeration cycle is kept high.

It goes without saying that, though the constant a equals 32 in the equation according to the present embodiment, the constant a may be more than 0 (including 0), but not more than 64 ($0 \leqq a \leqq 64$). According to the investigation, $8 \leqq a \leqq 56$ is preferable and $16 \leqq a \leqq 48$ is more preferable in view of preventing the spiral elements from being broken down. With respect to the winding turn X, less than 3.0 is preferable. Though both of the spiral elements 122 and 132 are provided with relief R in the embodiment mentioned above, it may be possible to have the relief at least only on one of the spiral elements. Though it was explained in the above embodiment about the case that the operation chambers P1, P2 and P3 (refer to FIG. 2) existed, there is a case that the operation chamber P3 does not exist, which depends on how many winding turns X the spiral elements 122 and 132 have and how much the rotating angle θ of the shaft 140 is. The relief R and the spiral elements 122 and 132 are not limited to the configuration shown in FIG. 2, but may have the other configuration.

What is claimed is:

1. A scroll type compressor comprising:

a housing;

a fixed scroll member fixed with the housing, the fixed scroll member having a spiral shaped fixed spiral element;

a movable scroll member making the rotating movement in the housing and having a spiral shaped movable spiral element to be contacted with the fixed spiral element in order to constitute an operation chamber where fluid is compressed; and reliefs provided on at least one of the spiral elements for preventing mutual contact of both of the spiral elements;

wherein the reliefs are formed at a center and an outer periphery portion of the at least one of the spiral elements and both of the spiral elements come to contact with each other at an intermediate portion between the center and the outer periphery portion, wherein the relief of the center portion is formed within the range defined by a winding angle Y of the spiral element in the below equation;

$$Y=a(X-1)$$

where

Y: winding angle,

X: winding turn of the spiral element, and a: $0 \leqq a \leqq 64$.

2. A scroll type compressor according to claim 1, wherein the range where both of the spiral elements come to contact with each other is 380°±20°.

* * * * *